US007765611B2

(12) United States Patent
Marshall et al.

(10) Patent No.: US 7,765,611 B2
(45) Date of Patent: Aug. 3, 2010

(54) REVERSIBLE WATER RESISTANT GARMENT

(75) Inventors: Barbara J. Marshall, Bratenahl, OH (US); Bethany S. Reid, Grand Haven, MI (US); Joan E. Oxender, Romeo, MI (US); Belinda Wietor, Romeo, MI (US)

(73) Assignee: Beeutiful Creations, LLC, Bratenahl, OH (US)

( * ) Notice: Subject to any disclaimer, the term of this patent is extended or adjusted under 35 U.S.C. 154(b) by 0 days.

(21) Appl. No.: 11/469,682

(22) Filed: Sep. 1, 2006

(65) Prior Publication Data

US 2007/0074329 A1 Apr. 5, 2007

Related U.S. Application Data

(60) Provisional application No. 60/713,985, filed on Sep. 2, 2005.

(51) Int. Cl.
*A41D 3/08* (2006.01)

(52) U.S. Cl. ..... 2/88; 2/84

(58) Field of Classification Search ..... 2/84, 2/87–89, 93, 69, DIG. 2, 104
See application file for complete search history.

(56) References Cited

U.S. PATENT DOCUMENTS

| | | | | | |
|---|---|---|---|---|---|
| 184,408 | A | * | 11/1876 | Meiter | 2/87 |
| 258,697 | A | * | 5/1882 | Bindseil | 2/88 |
| 301,118 | A | * | 7/1884 | Hamill | 2/87 |
| 331,179 | A | * | 11/1885 | Barter | 2/88 |
| 497,928 | A | * | 5/1893 | Scheimberg | 2/84 |
| 660,843 | A | * | 10/1900 | Coyle | 2/114 |
| 1,097,530 | A | * | 5/1914 | Cabelinsky | 2/84 |
| 1,337,698 | A | * | 4/1920 | Gongora | 2/247 |
| 1,467,718 | A | * | 9/1923 | Entrikin et al. | 2/88 |
| 1,485,392 | A | * | 3/1924 | Halek | 2/84 |
| 1,556,390 | A | * | 10/1925 | Woodley | 2/84 |
| 1,705,963 | A | * | 3/1929 | Clawson | 2/88 |
| 1,773,442 | A | * | 8/1930 | Speh | 2/94 |
| 1,914,236 | A | * | 6/1933 | Berkwits | 2/253 |
| 2,024,044 | A | * | 12/1935 | Johnson | 2/88 |
| 2,073,231 | A | * | 3/1937 | Siegel | 2/97 |
| 2,086,325 | A | * | 7/1937 | Frankel | 2/84 |
| 2,225,125 | A | * | 12/1940 | Nasher | 2/98 |
| 2,263,544 | A | * | 11/1941 | Rosenstein | 2/90 |
| 2,271,128 | A | * | 1/1942 | McCoy | 2/88 |
| 2,319,983 | A | * | 5/1943 | Furman | 2/1 |
| 2,334,061 | A | * | 11/1943 | Berkman | 2/84 |
| 2,376,345 | A | * | 5/1945 | Daiber | 2/173 |
| 2,667,641 | A | * | 2/1954 | Finnegan | 2/84 |
| 2,825,902 | A | * | 3/1958 | Breier | 2/93 |
| 2,898,599 | A | * | 8/1959 | Seckendorf | 2/88 |
| 3,014,218 | A | * | 12/1961 | Smith | 2/87 |
| 3,042,931 | A | * | 7/1962 | Sawyer | 2/88 |
| 3,085,254 | A | * | 4/1963 | Cutler | 2/243.1 |

(Continued)

*Primary Examiner*—Alissa L Hoey
(74) *Attorney, Agent, or Firm*—Hahn, Loeser & Parks LLP; Jason R. Strobel

(57) ABSTRACT

A reversible and water resistant garment includes a first side comprising a fabric layer and a second side comprising a polymeric layer. The garment resembles a cape and may comprise a hood, wherein the hood may be integral with at least one of the two layers. The garment may include one or more fasteners to secure the garment closed. The garment has one or more openings for the wearer to pass an arm through.

4 Claims, 6 Drawing Sheets

U.S. PATENT DOCUMENTS 3,201,801 A * 8/1965 Airasian ..... 2/93
3,258,781 A * 7/1966 Klein ..... 2/88
3,638,241 A * 2/1972 Holmes ..... 2/88
3,707,729 A * 1/1973 Scarsella ..... 2/88
3,846,844 A * 11/1974 Graf ..... 2/93
3,981,026 A * 9/1976 Reverberi ..... 2/1
4,067,067 A * 1/1978 Neuls ..... 2/84
4,078,264 A * 3/1978 DeGennaro et al. ..... 2/88
4,106,122 A * 8/1978 Dodd ..... 2/104
4,142,254 A * 3/1979 Arnold ..... 2/84
4,190,905 A * 3/1980 Reverberi ..... 2/1
4,202,053 A * 5/1980 Bell ..... 2/84
4,208,743 A * 6/1980 Whitcraft ..... 2/104
4,227,264 A * 10/1980 Spector et al. ..... 2/84
4,280,228 A * 7/1981 Sulzmann ..... 2/104
4,296,497 A * 10/1981 Herman ..... 2/114
4,301,547 A * 11/1981 Bloise ..... 2/88
4,570,266 A * 2/1986 Schlosser ..... 2/69
4,601,068 A * 7/1986 Frechette ..... 2/104
4,752,971 A * 6/1988 Meserol ..... 2/88
4,771,480 A * 9/1988 Stimson et al. ..... 2/88
5,056,160 A * 10/1991 Buchanan ..... 2/88
5,077,838 A * 1/1992 Senser ..... 2/69
5,101,513 A * 4/1992 Bowers ..... 2/84
5,165,111 A * 11/1992 Lieberman ..... 2/94
5,336,554 A * 8/1994 Knight ..... 428/137
5,414,881 A * 5/1995 Terrazas ..... 5/417
5,815,833 A * 10/1998 Kuo ..... 2/69.5
5,901,375 A * 5/1999 Davis ..... 2/84
6,047,404 A * 4/2000 Blanks ..... 2/69
6,324,697 B1 * 12/2001 Shofner ..... 2/102
6,370,692 B1 * 4/2002 Duyn et al. ..... 2/86
6,647,551 B2 * 11/2003 Palumbo ..... 2/69
6,708,343 B1 * 3/2004 Ceron ..... 2/88
6,845,518 B1 * 1/2005 Boesen ..... 2/86
6,851,127 B1 * 2/2005 Khan ..... 2/89
6,874,162 B2 * 4/2005 Boezi ..... 2/84
7,047,569 B1 * 5/2006 Mahon et al. ..... 2/88
7,082,617 B1 * 8/2006 Poindexter et al. ..... 2/48
7,251,840 B2 * 8/2007 Bayer ..... 2/227
2004/0154076 A1 * 8/2004 Yoo ..... 2/247
2004/0250331 A1 * 12/2004 Bayer ..... 2/69
2006/0206988 A1 * 9/2006 Hosogai ..... 2/247
2006/0206989 A1 * 9/2006 Hosogai ..... 2/247

* cited by examiner

REVERSIBLE WATER RESISTANT GARMENT

This application claims the benefit of U.S. provisional patent application Ser. No. 60/713,985, filed Sep. 2, 2005, and hereby incorporated by reference.

TECHNICAL FIELD

The present invention generally relates to garments, and more specifically to a reversible and water resistant garment.

BACKGROUND OF THE INVENTION

Many different types of garments are known that are intended to be water resistant and wind resistant. Common types of weather resistant garments include raincoats made entirely of plastic or other water resistant material that function like a typical jacket. Other types of water resistant garments include ponchos that are worn by pulling the neck slot of the poncho over a person's head. One problem with some poncho style garments is that they are difficult to put on in a hurry. Another problem with some weather resistant garments is that the time required to put the garment on may be too long. Often, for example, when a person exits a car during a rainstorm, he or she gets wet in the time it takes to don a jacket or poncho. This problem may be exacerbated when the user is carrying a briefcase, bag, etc. In addition to these problems, weather resistant garments are typically not very fashionable.

As such, there is a need for a water resistant garment that is both fashionable and functional, enabling it to be quickly put on, whether or not the person is toting a bag. Accordingly, the present invention is hereby submitted.

SUMMARY OF THE INVENTION

In response to the foregoing concerns, the present invention provides a reversible and water resistant garment comprising a body having a polymer layer and a fabric layer having a first edge and a second edge when laid in a flat position, a hood, and means for fastening the first edge to the second edge, where the polymer layer comprises a water resistant material.

An alternate embodiment of the present invention provides a reversible and water resistant garment comprising a body having a polymer layer and a fabric layer having an approximately elliptical shape when laid in a flat position with a first edge and a second edge, an angle between approximately 45 and 90 degrees between the first edge and the second edge when laid in a flat position, a hood, an opening having a size and position for a wearer's arm to pass through, and means for fastening the first edge to the second edge, where the polymer layer comprises a water resistant material.

BRIEF SUMMARY OF THE DRAWINGS

FIG. 5 is a front plan view of an embodiment of the reversible garment of the present invention having apertures for passing hands and arms through;

DETAILED DESCRIPTION

Figure 1:
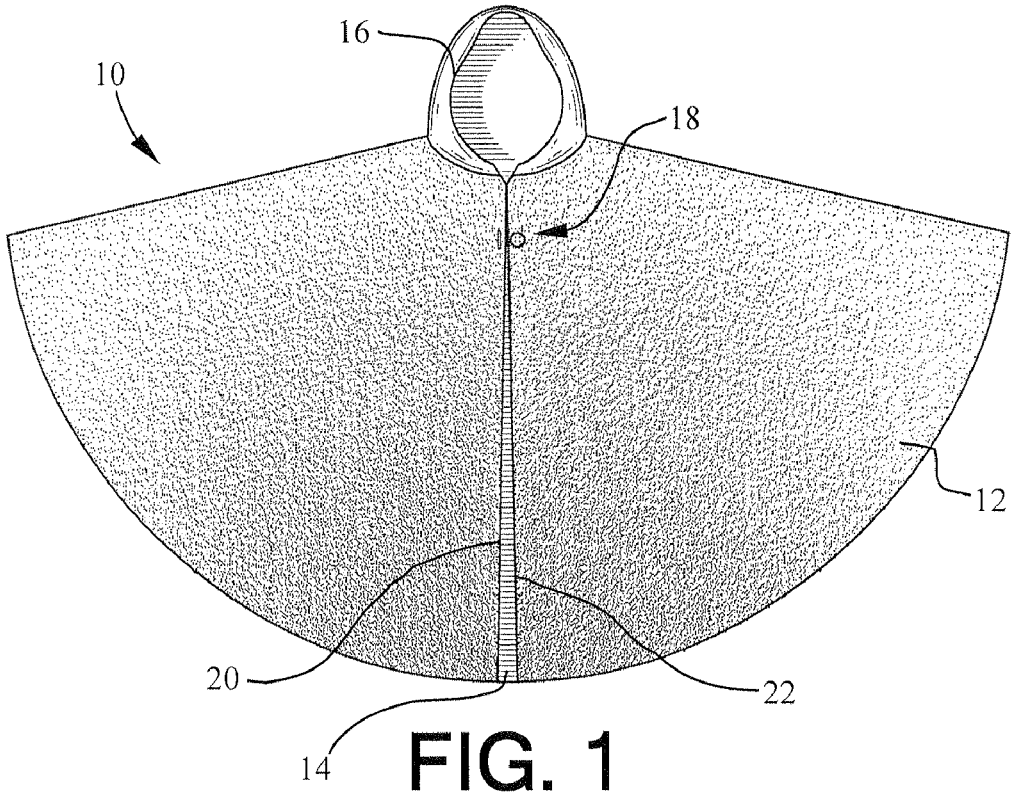
FIG. 1 is a front plan view of the reversible garment illustrating the fabric side facing outward.
Figure 2:
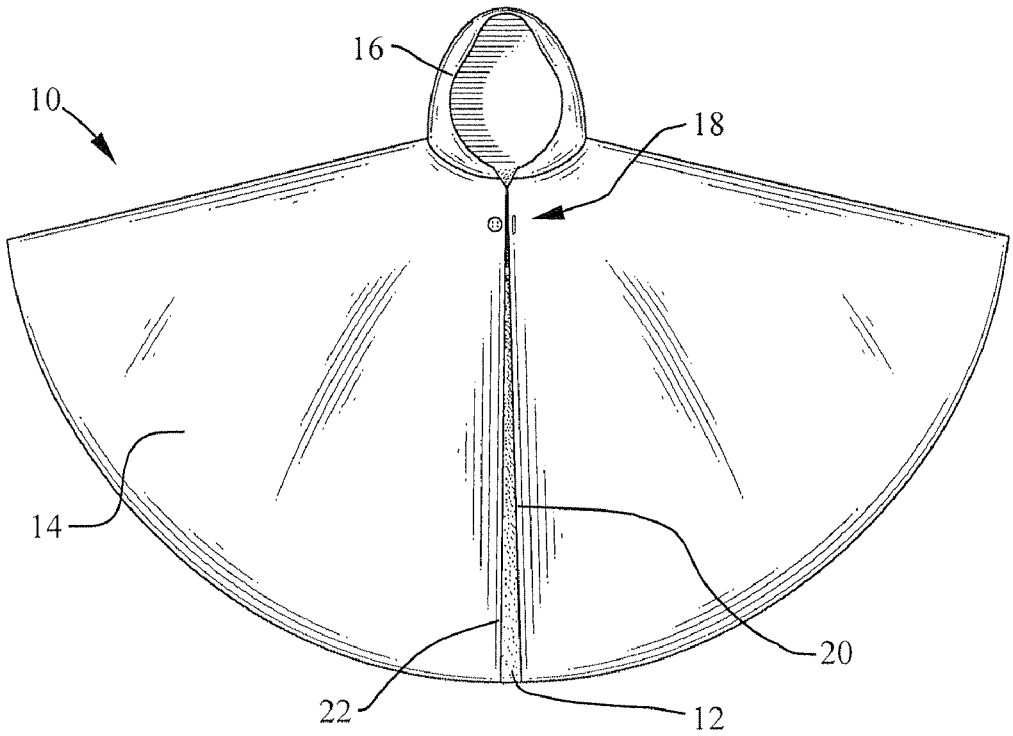
FIG. 2 is a front plan view of the reversible garment having the polymeric side facing outward.

An embodiment of a reversible water resistant garment 10 is illustrated in FIGS. 1 and 2. In the embodiment of FIGS. 1 and 2, garment 10 is bilaminar including a fabric layer 12 and polymer layer 14. The fabric layer 12, and fabric layer 112 below, may be any fabric or cloth known in the art, including but not limited to cotton, wool, leather, nylon, and polyester. Polymer layer 14 may be any water resistant fabric or cloth. As defined here, polymer layer 14, and polymer layer 114 below, includes but is not limited to polymeric materials, and may include any water repellant film, material, fabric, or cloth known in the art, including but not limited to nylon, polyvinyl chloride, polyester, and other polymeric fabrics, polymer coated fabrics, and other materials such as oilskin and leather that do not readily absorb water.

Figure 3:
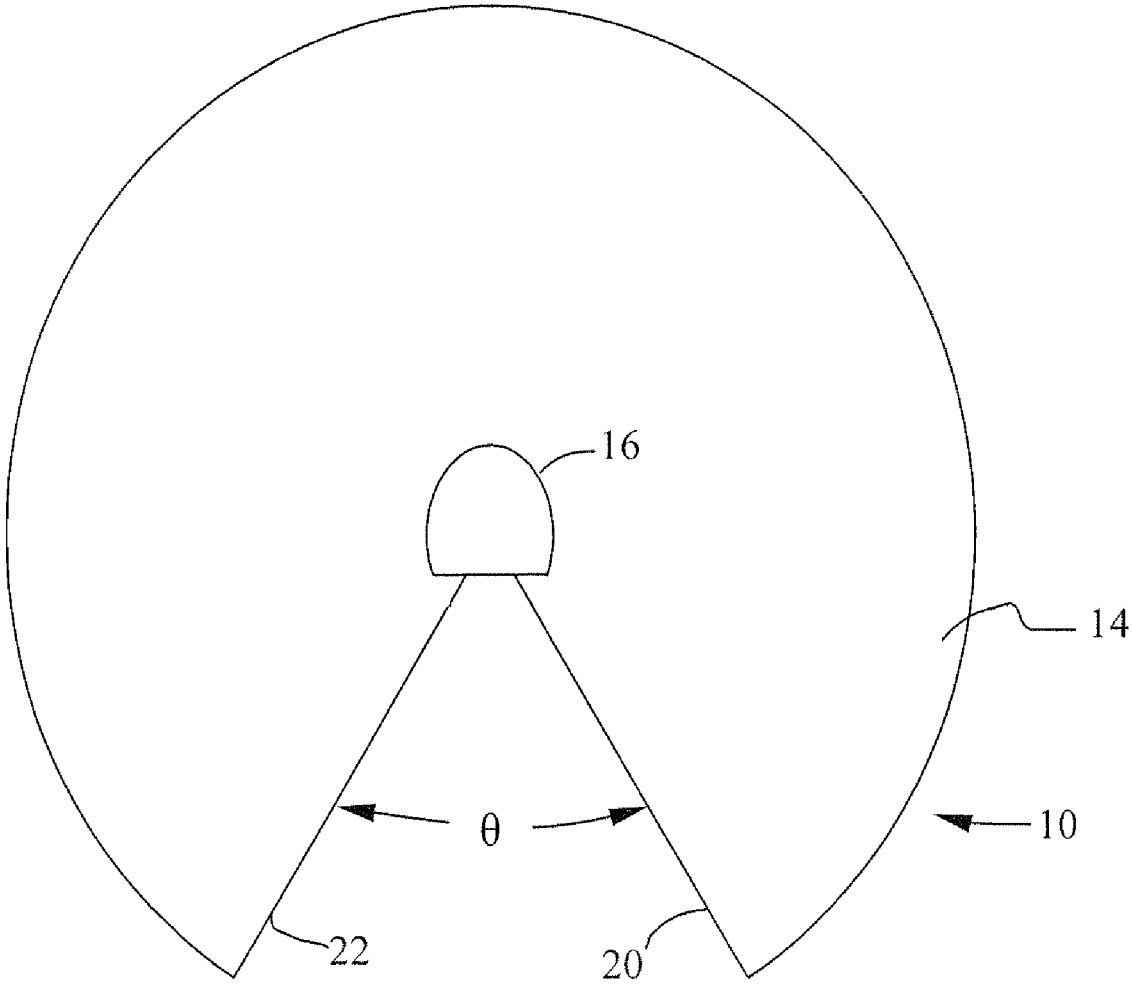
FIG. 3 is a top plan view of the reversible garment of FIG. 2 laid in a flat position.

In the embodiment of FIGS. 1 and 2, the body of garment 10 comprises two edges 20 and 22. When laid in a flat position show in FIG. 3, the body forms an approximately circular or elliptical shape with the edges 20, 22 separated by an angle θ. In the embodiment of FIGS. 1 and 2, the angle θ between the edges 20, 22 is an angle within a range of approximately 45 to 90 degrees. A smaller angle θ will result in a garment with a larger girth, while a larger angle θ will result in a garment with a smaller girth. It is contemplated that the angle θ between the edges 20, 22 may be smaller than 45 degrees, including angles between 0 and 45 degrees, or larger than 90 degrees. To put the garment on, the user would first separate the edges and quickly wrap the garment 10 around herself, bringing edges 20, 22 together. Once the garment 10 is wrapped around the user, the edges 20, 22 of the garment can be secured to each other via a means for fastening 18. The means for fastening 18 is illustrated in the figures as a button and slot fastener; however, it is anticipated that any of a multitude of fasteners can be utilized without deviating from the scope of the present invention. Means for fastening may comprise hook and loop style fasteners located on edges 20 and 22, either intermittently or continuously. Alternatively, means for fastening may include one or more buttons and slots, or snaps, or hooks and eyelets. It is contemplated that means for fastening may include one or more decorative fasteners, such as frogs, toggles, clasps, broaches, pins, buckles, or ties to fasten while enhancing the aesthetics of the garment. As the garment 10 may be reversible, it may have fastener components located on both the fabric side 12 and polymer side 14. For example, if the means for fastening 18 is a button-slot connection, a single slot could be selectively engageable with both a fabric side button and a polymer side button.

As can be seen in FIGS. 1 and 2, garment 10 may include a hood 16. In one embodiment, hood 16 is comprised of a polymeric material and is formed integrally with polymer layer 14. Alternately, hood 16 may be integral or monolithic with fabric layer 12, or may be similarly bilaminar as the remainder of the garment 10. Alternatively, the hood 16 may be removably attached to either or both of the layers 12, 14 by any means known in the art.

Figure 4:
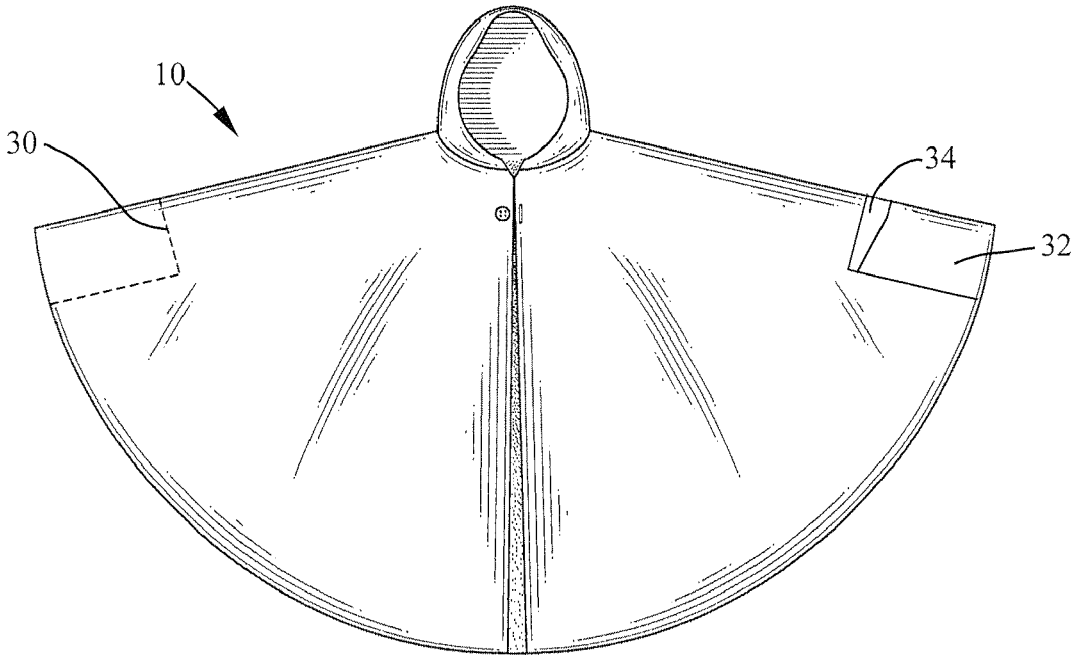
FIG. 4 is a front plan view of an embodiment of the reversible garment of the present invention having pockets.
Figure 10:
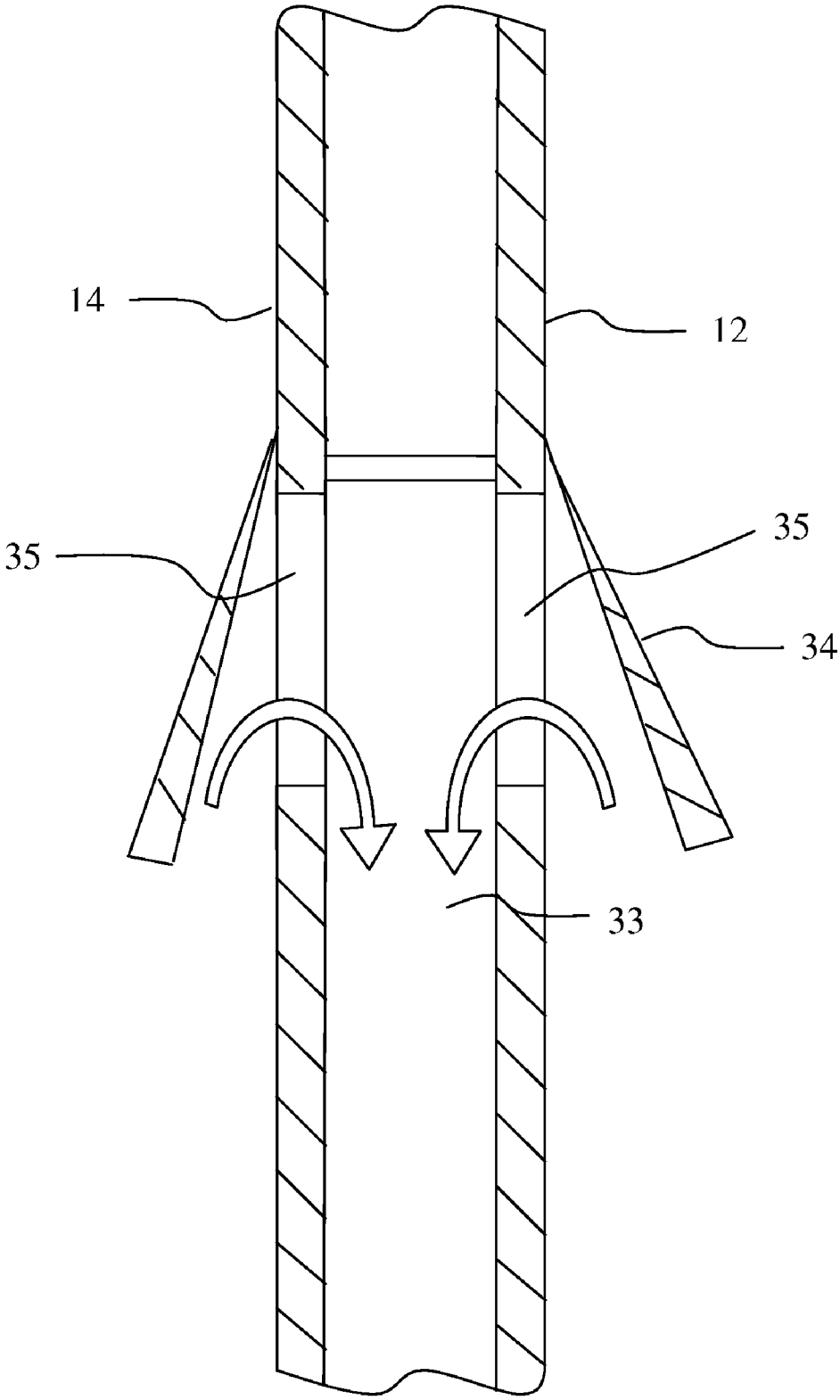
FIG. 10 is a cross-sectional view of a portion of a reversible garment, illustrating an embodiment of a pocket located between the layers of the garment.
Figure 11:
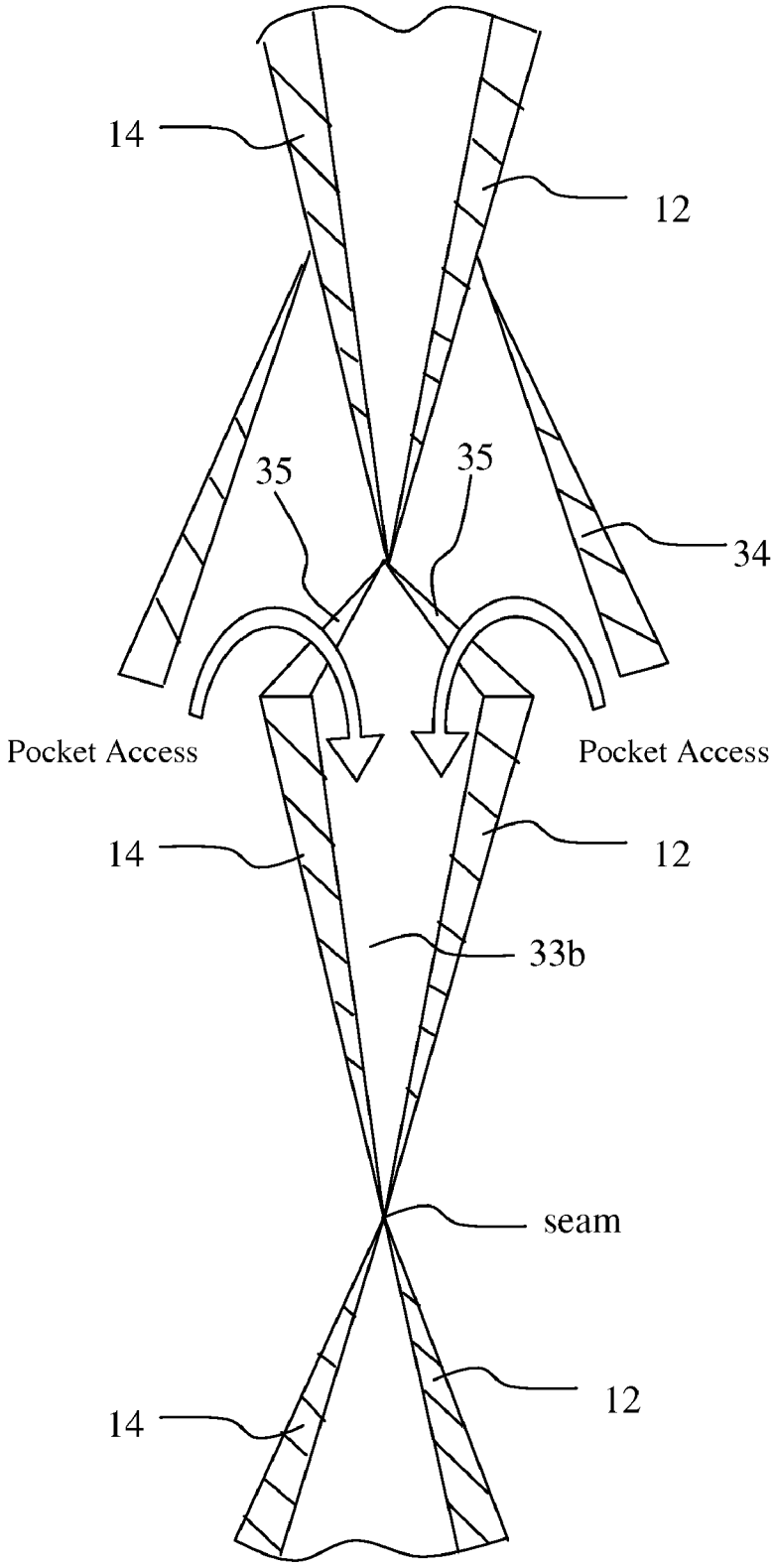
FIG. 11 is a cross-sectional view of a portion of a reversible garment, illustrating a second embodiment of a pocket formed as a potential space between the layers of the garment.

In the embodiment shown in FIG. 4, the garment further comprises one or more pockets 30, 32. The pockets 30, 32 may be incorporated on the fabric layer 12 as indicated by pocket 30, or on the polymer layer as indicated by pocket 32. The pocket 32 on the polymer layer 14 may further comprise a flap 34 to deflect water from the opening of the pocket 32. Alternatively, as shown in FIG. 10, the pocket 33 may be formed such that it is accessible from either the polymer layer 14 or the fabric layer 12. In such an embodiment, both the polymer layer 14 and fabric layer 12 may have an access opening or slit 35 and any means of closing the opening as is known in the art, such as snaps, flaps, zippers and the like. In one embodiment, the pocket could be formed as a potential space 33*b* between the fabric layer 12 and polymer layer 14.

Figure 5:
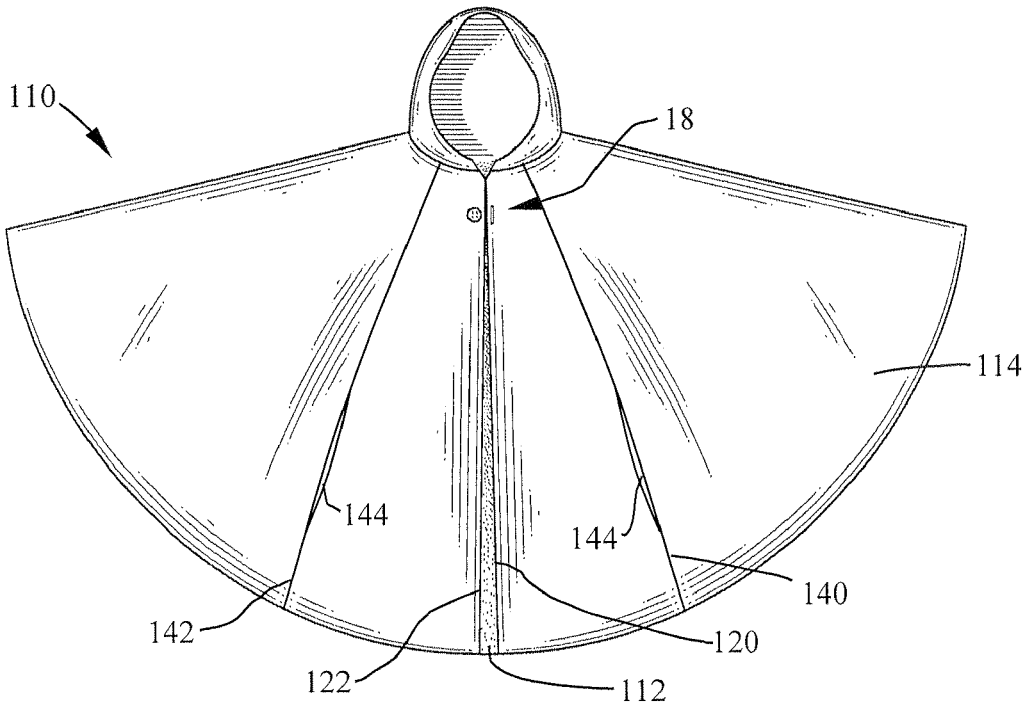
Figure 6:
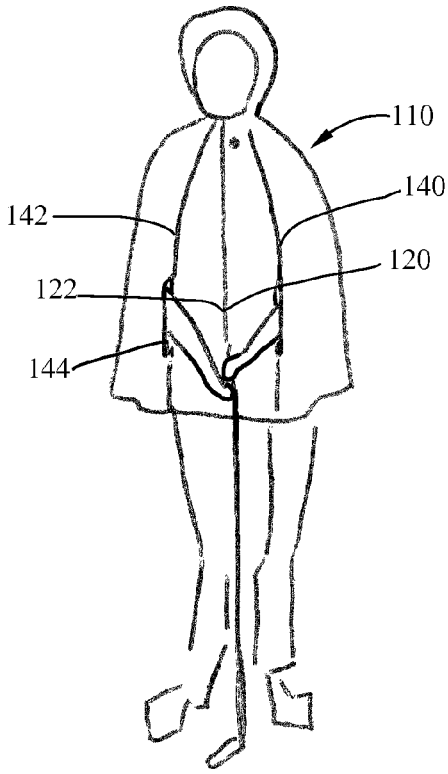
FIG. 6 is a perspective view of a user wearing the reversible garment of FIG. 5.

In one embodiment shown in FIGS. 5 and 6, a reversible garment 110 is bilaminar including a fabric layer 112 and polymer layer 114. The body of garment 110 comprises two edges 120 and 122. When laid in a flat position exemplified by FIG. 3, the body forms an approximately circular or elliptical shape with the edges 120, 122 separated by an angle θ. In the embodiment of FIGS. 5 and 6, the angle θ between the edges 120, 122 is an angle within a range of approximately 45 to 90 degrees. A smaller angle θ will result in a garment with a larger girth, while a larger angle θ will result in a garment with a smaller girth. It is contemplated that the angle θ between the edges 120, 122 may be smaller than 45 degrees, including angles between 0 and 45 degrees, or larger than 90 degrees. The garment 110 further comprises seams 140, 142 on the front of the garment. Seams 140, 142 may extend from the hood 16 to the lower edge of the garment as shown in FIG. 5. An opening 144 is positioned adjacent to or within one or both of the seams 140, 142. The openings 144 are sized and located so that a person who is wearing the garment can pass his or her arm through the opening 144, as indicated in FIG. 6.

Figure 7:
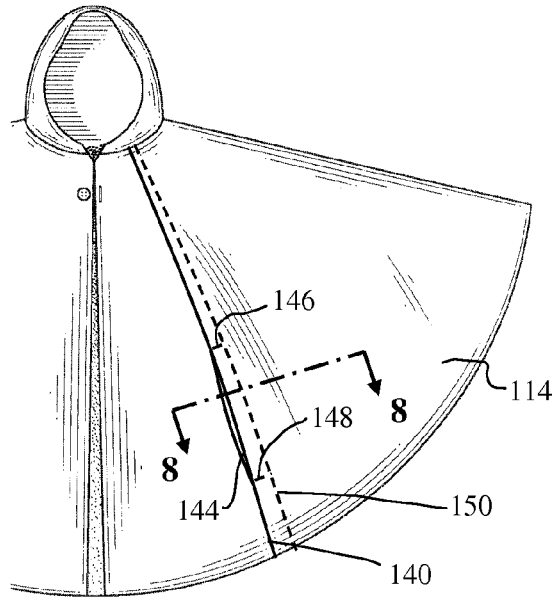
FIG. 7 is a partial front plan view of the reversible garment of FIG. 5.
Figure 8:
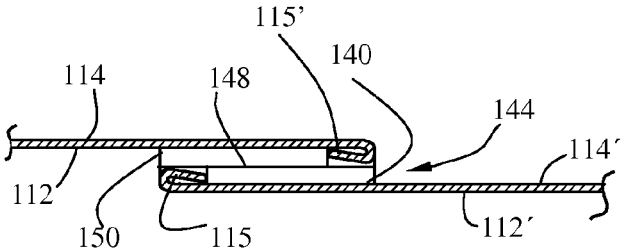
FIG. 8 is a cross sectional view through section 8-8 in FIG. 7.
Figure 9:
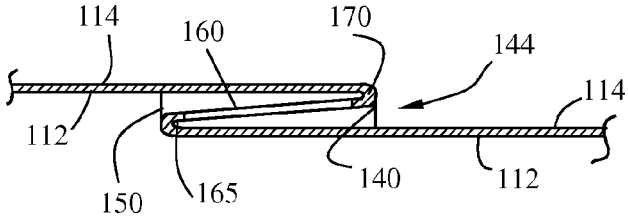
FIG. 9 is a cross sectional view of an alternate embodiment of section 8-8 in FIG. 7.

In the embodiments illustrated by FIGS. 7-9, the openings 144 are constructed within the seams 140, 142 so that the openings 144 are hidden. Reinforcing seams 146, 148 may bound the openings 144. In the embodiment of FIG. 8, the opening 144 is constructed between overlapping material portions 115 and 115'. Material portion 115 is a bilaminar composite of polymer layer 114 on one side, and fabric layer 112 on the other side, and material portion 115' is a bilaminar composite of polymer layer 114' on one side, and fabric layer 112' on the other side. In the embodiment of FIG. 8, seam 150 is adjacent to an edge of bilaminar material portion 115', and seam 140 is adjacent to an edge of overlapping bilaminar material portion 115. In this embodiment, the seams 140, 150 engage both overlapping material portions 115 and 115' to stitch them together, except at the opening 144. At the location of opening 144, the seams 140, 150 do not go through both material portions 115 and 115'; instead, at the location of opening 144 material portions 115 and 115' are not affixed together so as to create the opening 144. In the embodiment of FIG. 8, the patterns and colors of material portion 115 may be different from the patterns and colors of material portion 115'.

In an alternate embodiment, the amount of overlap in FIG. 8 is approximately zero. In this alternate embodiment, the seams 140 and 150 may be adjacent, or may be the same seam joining the material portion 115 to the material portion 115'. In this embodiment, a gap in the stitching that affixes the material portions 115, 115' together forms the opening 144 in the junction between the material portions 115, 115'.

In the embodiment of FIG. 9, the opening 144 is a cut or slit in a pleat 160 in the material portion 115. In the embodiment of FIG. 9, seam 150 is adjacent to an edge of a first fold 165 in the pleat 160, and seam 140 is adjacent to an edge of a second fold 170 in the pleat 160. The seam 150 engages both the first fold 165 and overlapping material portion 115 to stitch them together, except at the opening 144. Likewise, the seam 140 engages both the material portion 115 and the overlapping second fold 170 to stitch them together, except at the opening 144. At the location of opening 144, the seams 140, 150 do not go through both the pleat and the material portion 115; instead, at the location of opening 144 the folds are not affixed to the overlapping material portion 115 so as to leave the opening 144.

In an alternate embodiment, seams 140, 142 do not extend from the hood 16 to the lower edge of the garment. Instead, the opening 144 is a slit in the material portion 115 and the seams 140, 142 exist only along an outer edge of the opening 144.

Each opening 144 may be fastened closed by one or more means for fastening 18, such as, but not limited to, snap fasteners, buttons, or hook and loop style fasteners as defined above. By employing one or more fasteners to close the openings 144, the garment will be more secure against rain and wind. In one embodiment, a flap covers the opening 144. It is contemplated that a flap may be attached to the polymer layer 114 or the fabric layer 112, or one flap on each layer 112, 114.

In the embodiments shown in FIGS. 1-7, the garment 10, 110 does not include sleeves for a user's arm. Garment 10, 110 may be used for short durations, such as traveling from a vehicle to a building. The lack of sleeves is useful when the user is carrying articles such as briefcases, grocery bags, or other articles. The user can carry the article beneath the shelter of the garment. The user may be able to wrap the garment 10, 110 around herself and the article and secure it without first setting down the article.

Fabric layer 12 and polymer layer 14 may include any of a multitude of colors, patterns, and designs. It is contemplated that the colors, patterns, and designs incorporated in fabric layer 12 and polymer layer 14 may include fashionable patterns and designs, sports team colors and insignias, school colors and insignias, promotional slogans and logos, and trademarks. Further, it is contemplated that the combination of the fabric layer 12 and polymer layer 14 may be different colors to represent any of a plurality of sports teams, school color schemes, and other fashionable and promotional designs.

It is contemplated that the polymer layer 14, 114 may include throughout its surface small apertures to provide breathability to the polymer. Although a polymeric layer containing tiny apertures may not be totally water resistant, the small apertures will not significantly compromise the weather resistance of the garment. The small apertures in the polymer layer 14, 114 will make the polymer layer 14, 114 somewhat breathable. And because fabric layer 12, 112 may also be a breathable material, the combination of the two layers may provide a breathable garment that is comfortable to wear.

The bilaminar construction of the garment is advantageous in certain circumstances. When the weather includes no precipitation or light precipitation, the user may wear the garment 10, 110 with the fabric side 12, 112 facing outward, which provides some weather resistance but still enables the user to wear a fashionable garment. During more severe weather, the user may wish to wear the garment with polymer layer 14, 114 facing outward, so to avoid the fabric side 12,

112 from becoming soaked. In either instance, the bilaminar construction provides two different looking garments in a single package.

Additional advantages and modifications will readily occur to those skilled in the art. For example, the garment could be constructed on two layers of fabric with a polymer intermediate layer, with the two fabric layers having different colors or patterns. Therefore, the invention in its broader aspects is not limited to the specific details and illustrative examples shown and described herein. Accordingly, various modifications may be made without departing from the scope of the general inventive concept disclosed herein.

We claim:

1. A reversible and water resistant garment comprising:

a body having a polymer layer and a fabric layer having an approximately elliptical shape when laid in a flat position with a top end and a bottom end and a first edge and a second edge, the first edge and second edge defining a garment opening in the body, where the garment opening extends from the top end to the bottom end of the body and defines an angle between the first edge and the second edge, wherein the angle is between approximately 45 and 90 degrees when the garment is laid in a flat position;

at least one pleat formed in the body and extending from the top end to the bottom end, the at least one pleat having a first stitched seam adjacent a first fold in the pleat, a second stitched seam adjacent a second fold in the pleat, and an opening through the pleat located between the first fold and the second fold, the opening having a size and position for an associated user's arm to pass through;

a hood;

a pocket located between the polymer layer and fabric layer; wherein the pocket is accessible from both the polymer layer and the fabric layer; and means for fastening the first edge to the second edge;

wherein the polymer layer comprises a water resistant material.

2. The reversible garment of claim 1, wherein the hood comprises a single layer and is integral with either of the polymer layer or the fabric layer.

3. The reversible garment of claim 1, wherein the hood is removably attached to the body.

4. The reversible garment of claim 1, wherein the pocket is accessible through either of a slit in the polymer layer or a slit in the fabric layer and formed as a space between the polymer layer and the fabric layer.

* * * * *